US006153344A

United States Patent [19]

Miyamoto et al.

[11] Patent Number: 6,153,344

[45] Date of Patent: Nov. 28, 2000

[54] POSITIVE CHARGING SINGLE-LAYER TYPE ELECTROPHOTOSENSITIVE MATERIAL

[75] Inventors: Eiichi Miyamoto; Susumu Hiroshima, both of Osaka, Japan

[73] Assignee: Kyocera Mita Corporation, Osaka, Japan

[21] Appl. No.: 09/556,942

[22] Filed: Apr. 21, 2000

[30] Foreign Application Priority Data

May 21, 1999 [JP] Japan ..... 11-141646

[51] Int. Cl.[7] ..... G03G 5/09

[52] U.S. Cl. ..... 430/83; 399/159

[58] Field of Search ..... 430/83; 399/159

[56] References Cited

U.S. PATENT DOCUMENTS 5,240,802 8/1993 Molaire et al. ..... 430/83
5,492,784 2/1996 Yoshkawa et al. ..... 430/83
5,968,697 10/1999 Tomiuchi et al. ..... 430/83
5,989,766 11/1999 Jeong et al. ..... 430/83

*Primary Examiner*—Roland Martin
*Attorney, Agent, or Firm*—Smith, Gambrell & Russell, LLP

[57] ABSTRACT

The present invention relates to a positive charging single-layer type electrophotosensitive material comprising a conductive substrate and a photosensitive layer provided on the conductive substrate, said photosensitive layer comprising an electron charge generating material, a hole transferring material, an electron transferring material and a binder resin, wherein a mobility of the hole transferring material at an electric field strength of $5\times10^5$ V/cm is not less than $1\times10^{-5}$ $cm^2$/V/sec and the electron transferring material has a mobility of not less than 1/20000 and not more than 1/10 relative to that of the hole transferring material. Said positive charging single-layer type photosensitive material has a sufficient sensitivity even when used in a high-speed image forming apparatus capable of taking 50 or more copies of a A4-size original.

5 Claims, 3 Drawing Sheets

POSITIVE CHARGING SINGLE-LAYER TYPE ELECTROPHOTOSENSITIVE MATERIAL

BACKGROUND OF THE INVENTION

1. Field of the Invention

The present invention relates to an electrophotosensitive material which is used in image forming apparatuses such as electrostatic copying machine, facsimile, laser beam printer and the like.

2. Description of the Prior Art

In the image forming apparatuses, various organic photosensitive materials having a sensitivity within a wavelength range of a light source used in the image forming apparatuses can be used. Recently, these organic photosensitive materials have widely been used because of easier production than that in the case of a conventional inorganic photosensitive material, various selective materials for photosensitive material, for example, electric charge transferring material, electric charge generating material, binding resin, etc., and high design freedom.

The organic photosensitive material includes, for example, a single-layer type photosensitive material wherein an electric charge transferring material and an electric charge generating material are dispersed in the same photosensitive layer, and a multi-layer photosensitive meterial comprising an electric charge generating layer containing an electric charge generating material and an electron transferring layer containing an electron transferring material, which are mutually laminated.

The single-layer type photosensitive material has attracted special interest recently by the following reasons. That is, the single-layer type photosensitive material can be easily produced because of its simple structure and film defects can be inhibited on formation of layers and, furthermore, optical characteristics can be improved because of less interface between layers. The single-layer type photosensitive material can be used in any of positive and negative charging type apparatuses, but is exclusively used in a positive charging type apparatus in view of characteristics of constituent materials of the photosensitive material.

An image forming apparatus using the single-layer type photosensitive material has the following advantages and a market for the image forming apparatus has been cultivated.

(1) High image quality is attained because turbulance of move of electric charges between the electric charge generating layer and electric charge transferring layer occurs, like a multi-layer type one.

(2) When using in a positive charging type pparatus, ozone which is detrimental to the human body is hardly evolved.

To meet requirements to an image forming apparatus, such as high speed and energy saving, which have recently been increased more and more, the sensitivity of a conventional single-layer photosensitive material has become insufficient at present.

When using a conventional positive charging single-layer type electrophotosensitive material in an image forming apparatus having a high process speed, which is capable of taking 50 or more copies of a A4-size original, a dose of exposure light is small and a time required for a photosensitive material drum to move from the exposure position to the developing position is short, thereby causing a phenomenon that a developing process is attained during potential attenuation due to exposure.

As a result, the following problems occur. That is, an excess dose of light is required to lower a light potential of the photosensitive material and a change in light potential due to an environmental change increases because of the potential attenuation and, furthermore, the degree of fatigue in the photosensitive material due to repeating of exposure and development becomes severe. Consequently, it becomes difficult to obtain a good image.

SUMMARY OF THE INVENTION

Thus, an object of the present invention is to provide a positive charging single-layer type electrophotosensitive material, which has particularly high sensitivity and can sufficiently meet requirements to an image forming apparatus, such as high speed and energy saving.

To solve the above problems, the present inventors have intensively studied and found that there can be obtained a positive charging single-layer type photosensitive material comprising at least an electron charge generating material, a hole transferring material, an electron transferring material and a binder resin, which has a sufficient sensitivity even when used in a high-speed image forming apparatus capable of taking 50 or more copies of a A4-size original, in case where a mobility of the hole transferring material at an electric field strength of $5\times10^5$ V/cm is not less than $1\times10^{-5}$ $cm^2$/V/sec and the electron transferring material has a mobility of not less than 1/20000 and not more than 1/10 relative to that of the hole transferring material. Thus, the present invention has been completed and includes the following inventions:

(1) A positive charging single-layer type electrophotosensitive material comprising a conductive substrate and a photosensitive layer provided on the conductive substrate, said photosensitive layer comprising an electron charge generating material, a hole transferring material, an electron transferring material and a binder resin, wherein a mobility of the hole transferring material at an electric field strength of $5\times10^5$ V/cm is not less than $1\times10^{-5}$ $cm^2$/V/sec and the electron transferring material has a mobility of not less than 1/20000 and not more than 1/10 relative to that of the hole transferring material.

(2) The positive charging single-layer type electrophotosensitive material according to the item 1, wherein the electric charge generating material is a phthalocyanine compound.

(3) The positive charging single-layer type electrophotosensitive material according to the item 2, wherein a residual potential at the time of irradiation with monochromic light having a wavelength of 780 nm and a light intensity of 15 $\mu$W for 40 msec is not more than 170 V.

(4) The positive charging single-layer type electrophotosensitive material according to the item 2, herein an initial surface potential at the time at which a value of a current to be applied into the photosensitive layer is 12 $\mu$A is not less than 750 V.

(5) A high-speed digital image forming apparatus, which is capable of taking 50 or more copies of a A4-size original wherein the positive charging single-layer type electrophotosensitive material of the item 2 is used in said apparatus.

According to the present invention, there can be obtained a positive charging single-layer type photosensitive material comprising at least an electron charge generating material, a hole transferring material, an electron transferring material and a binder resin, which has a sufficient sensitivity even when used in a high-speed image forming apparatus capable of taking 50 or more copies of a A4-size original, in case where a mobility of the hole transferring material at an electric field strength of $5\times10^5$ V/cm is not less than $1\times10^{-5}$ $cm^2$/V/sec and the electron transferring material has a mobility of not less than 1/20000 and not more than 1/10 relative to that of the hole transferring material.

The reason why the positive charging single-layer type photosensitive material having a high sensitivity could be obtained as described above is assumed as follows.

Among photoproduced carriers, electrons reach the surface of a photosensitive layer, whereas, holes reach a conductive substrate side, thereby to cause photoattenuation. Since the generation of electric charges is unevenly distributed in the vicinity of the surface of the photosensitive layer, the mobility of holes are longer than that of electrons, necessarily.

First, when the mobility of an electron transferring material is smaller than 1/20000 as compared with a hole transferring material having a mobility of not less than $1\times10^{-5}$ $cm^2$/V/sec at an electric field strength of $5\times10^5$V/cm, electrons which could not reach the surface of the photosensitive layer are remained in the photosensitive layer due to a difference in mobility between the hole transferring material and electron transferring material. Therefore, the electric charge generation efficiency does not increase, which leads to lowering of the sensitivity of the photosensitive material, thereby making it difficult to obtain a sufficient image density in a high-speed image forming apparatus.

On the other hand, when the mobility of the electron transferring material is 1/10 times larger than that of the hole transferring material, positive electric charges on the surface of the photosensitive layer are negated before holes reach the conductive substrate, thereby to lower the electric field strength of the photosensitive layer. Therefore, the mobility of holes is controlled furthermore, thereby to lower the sensitivity. Since positive electric charges of the surface of the photosensitive layer are negated, the surface potential of the photosensitive material tends to be lowered and image fog is liable to occur.

DETAILED DESCRIPTION OF THE INVENTION

Figure 1:
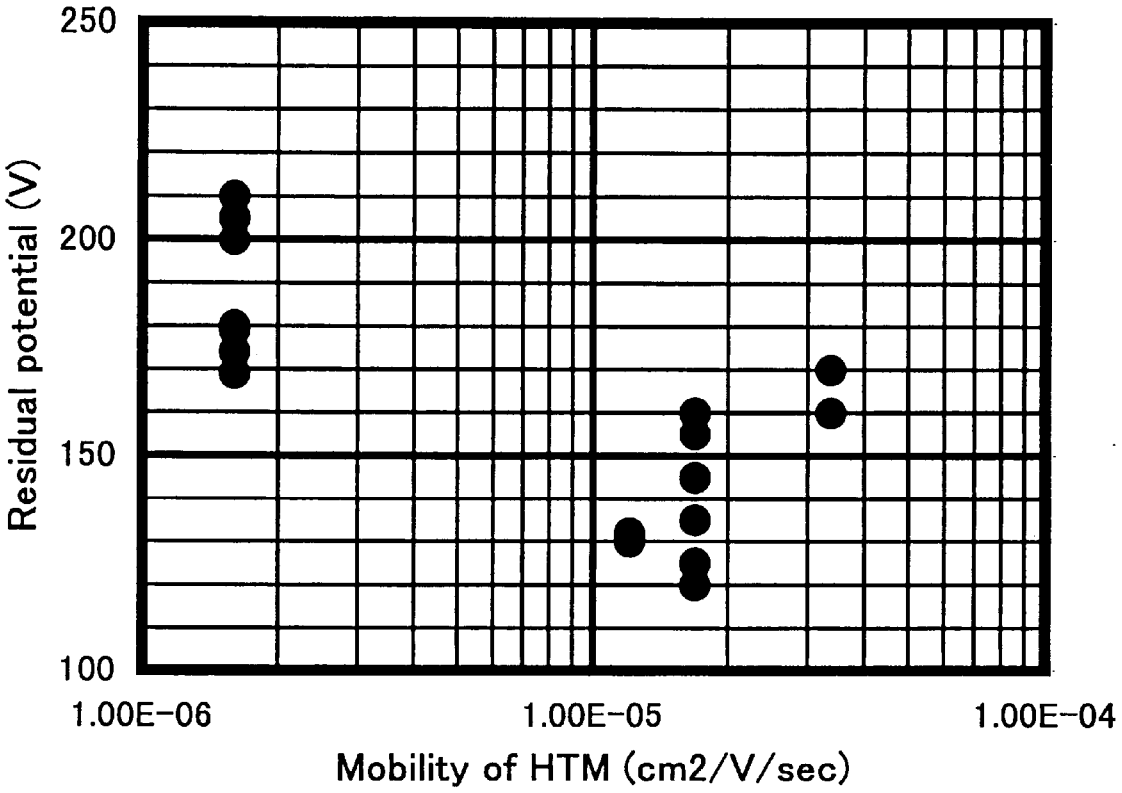
FIG. 1 is a graph showing a relation between a residual potential of a photosensitive material and a mobility of a hole transferring material (HTM).

The single-layer type electrophotosensitive material is that obtained by providing a single photosensitive layer on a conductive substrate. This photosensitive layer is formed by dissolving or dispersing an electric charge generating material, a hole transferring material, an electron transferring material and a binder resin in a proper solvent, coating the resulting coating solution on a conductive substrate, and drying the coating solution.

Various materials used in the positive charging single-layer type electrophotosensitive material of the present invention will be described below.

<Electric charge generating agent>

The electric charge generating material includes, for example, phthalocyanine pigment, polycyclic quinone pigment, azo pigment, perylene pigment, indigo pigment, quinacridone pigment, azulenium salt pigment, squalium pigment, cyanine pigment, pyrylium dye, thiopyrylium dye, xanthene dye, quinoneimine pigment, triphenylmethane pigment, styryl pigment, selenium, tellurium, amorphous silicon, and cadmium sulfide, and these electric charge generating materials can be used alone, or two or more kinds of them can be used in combination. These electric charge generating materials are preferably contained in the amount within a range from 0.1 to 30% by weight, and more preferably from 0.5 to 10% by weight, based on the binder resin. Among these electric charge generating material, for example, phthalocyanine pigments such as metal-free phthalocyanine represented by the general formula (CG1) and oxotitanyl phthalocyanine represented by the general formula (CG2) are preferably used because a photosensitive material having a sensitivity within a wavelength range of not less than 700 nm is required in an image forming apparatus such as laser beam printer using a light source such as semiconductor laser, facsimile and the like. The crystal form of the phthalocyanine pigment is not specifically limited, and various phthalocyanine pigments can be used.

(CG1) Metal-free phthalocyanine

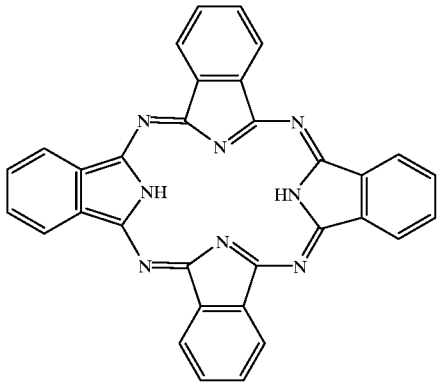

(CG2) Oxotitanyl phthalocyanine

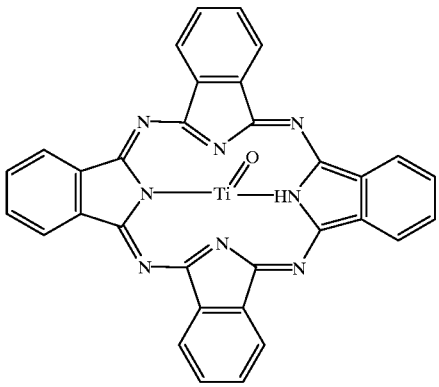

<Hole transferring material>

It is necessary that the hole transferring material used in the photosensitive material of the present invention has a mobility of not less than $1\times10^{-5}$ $cm^2$/V/sec at an electric field strength of $5\times10^5$ V/cm. The hole transferring material includes, for example, compounds represented by the following general formulas (HT-1) to (HT-3).

(HT1) having a mobility of $1.21\times10^{-5}$ $cm^2/V/sec$

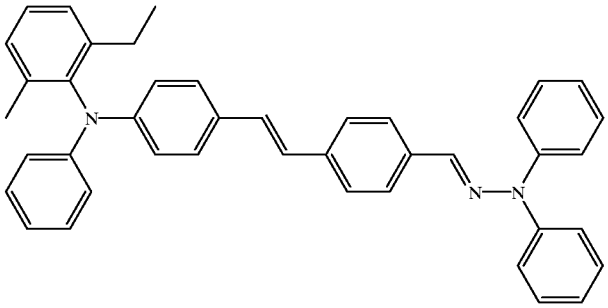

(HT2) having a mobility of $1.69\times10^{-5}$ $cm^2$ /V/sec

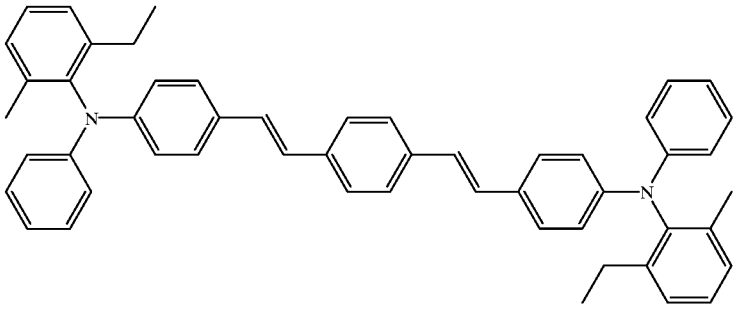

(HT3) having a mobility of $3.83\times10^{-5}$ $cm^2/V/sec$

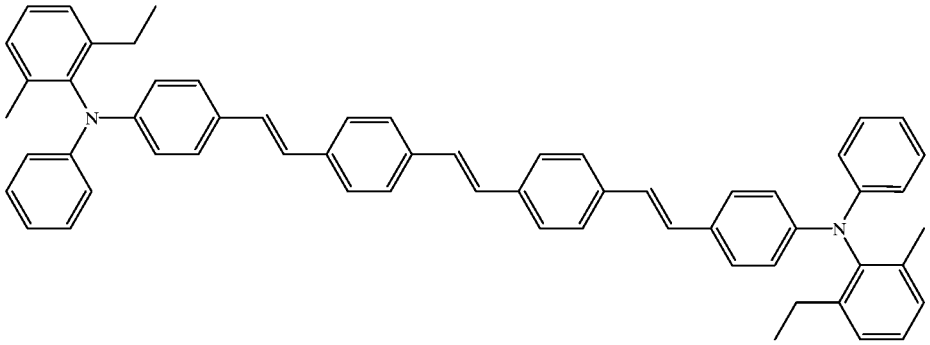

In the present invention, these hole transferring materials can be used alone, or two or more kinds of them can be used in combination. The amount of the hole transferring material is preferably within a range from 5 to 500% by weight, and more preferably from 25 to 200% by weight, based on the binder resin.

<Electron transferring material>

It is necessary that the electron transferring material used in the single-layer type positive charging photosensitive material of the present invention has a mobility of not less than 1/20000 and not more than 1/10 relative to that of the hole transferring material described above. The electron transferring material includes, for example, compounds represented by the following general formulas (ET-1) to (ET-7). (ET1) having a mobility of $1.75\times10^{-9}$ $cm^2/V/sec$

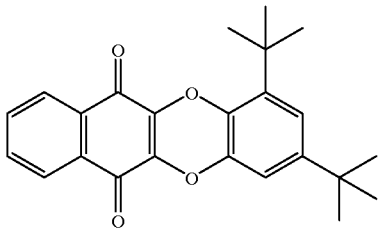

(ET2) having a mobility of $5.32\times10^{-9}$ $cm^2/V/sec$

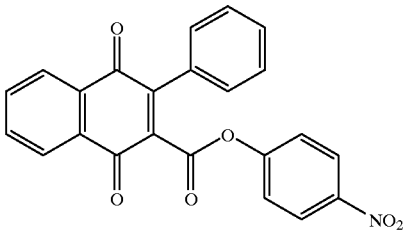

(ET3) having a mobility of $1.67\times10^{-8}$ $cm^2/V/sec$

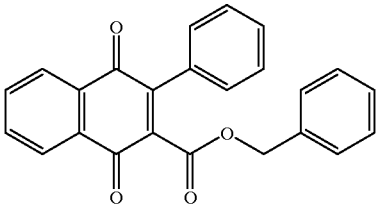

(ET4) having a mobility of $6.13\times10^{-8}$ $cm^2/V/sec$

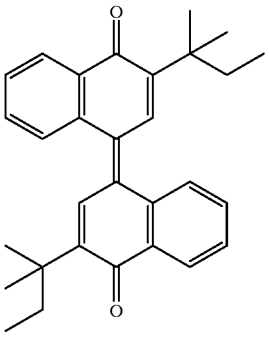

(ET5) having a mobility of $1.37\times10^{-7}$ $cm^2/V/sec$

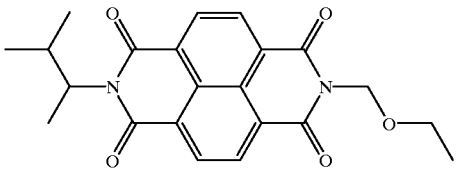

(ET6) having a mobility of $3.47\times10^{-7}$ $cm^2/V/sec$

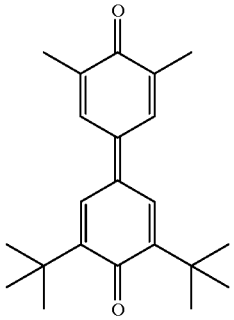

(ET7) having a mobility of $1.04\times10^{-6}$ $cm^2/V/sec$

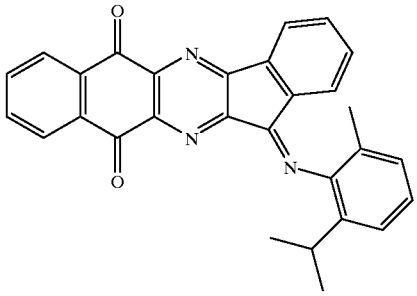

In the present invention, these electron transferring materials can be used alone or two or more kinds of them can be used in combination. The amount of the electron transferring material is preferably within a range from 5 to 100% by weight, and more preferably from 10 to 80% by weight, based on the binder resin.

The mobility was measured at normal temperature by a conventional TOF (Time Of Flight) method. The electric field strength was $5\times10^5$V/cm. The measuring sample was made by dissolving 40% by weight of an electric charge transferring material in a binder resin (bis-Z type polycarbonate resin having a weight-average molecular weight of 20,000), coating the resulting coating solution on a substrate, and subjecting to a heat treatment at 80° C. for 30 minutes. The film thickness of the sample is 7 $\mu$m.

<Binder resin>

As the binder resin in which the above respective components are dispersed, there can be used various resins which have hitherto been used in the photosensitive layer. For example, there can be used thermoplastic resins such as styrene polymer, styrene-butadiene copolymer, styrene-acrylonitrile copolymer, styrene-maleic acid copolymer, acrylic polymer, styrene-acrylic copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyacrylate, polysulfone, diallyl phthalate resin, ketone resin, polyvinyl butyral resin, and polyether resin; crosslinkable thermosetting resins such as silicone resin, epoxy resin, phenol resin, urea resin, and melamine resin; and photocurable resins such as epoxy acrylate and urethane acrylate. These binder resins can be used alone, or two or more kinds of them can be used in combination.

In addition to the above respective components, various conventionally known additives such as antioxidants, radical scavengers, singlet quenchers, deterioration inhibirtors (e.g. ultraviolet absorbers), softeners, plasticizers, surface modifiers, extenders, thickeners, dispersion stabilizers, waxes, acceptors, and donors can be incorporated into the photosensitive layer as far as the additives do not exert a deleterious influence on electrophotographic characteristics. To improve the sensitivity of the photosensitive layer, for example, known sensitizers such as terphenyl, halonaphthoquinones, and acenaphthylene may be used in combination with the electric charge generating material.

The thickness of the photosensitive layer in the single-layer type positive charging electrophotosensitive material is within a range from 5 to 100$\mu$, and preferably from 10 to 50 $\mu$m.

In the single-layer type positive charging electrophotosensitive material, a barrier layer may be formed between the conductive substrate and photosensitive layer as far as it does not inhibit characteristics of the photosensitive material. A protective layer may be formed on the surface of the photosensitive material.

As the conductive substrate on which the photosensitive layer is formed, for example, various materials having the conductivity can be used. The conductive substrate includes, for example, metallic simple substances such as iron, aluminum, copper, tin, platinum, silver, vanadium, molybdenum, chrome, cadmium, titanium, nickel, palladium, indium, stainless steel, and brass; plastic materials prepared by depositing or laminating the above metal; and glasses coated with aluminum iodide, tin oxide, and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength on use.

When the photosensitive layer is formed by the coating method, a dispersion is prepared by dispersing and mixing the above hole transferring material, electric charge generating material, electron acceptor and binder resin, together with a proper solvent, using a known method such as roll mill, ball mill, attritor, paint shaker, and ultrasonic dispersing equipment, and then the resulting dispersion is coated by using a known means and dried.

As the solvent for preparing the dispersion, various organic solvents can be used. The organic solvent includes, for example, alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, and cylohexanone; esters such as ethyl acetate and methyl acetate; and dimethylformaldehyde, dimethylformamide, and dimethyl sulfoxide. These solvents can be used alone, or two or more kinds of them can be used in combination.

To improve the dispersion properties of the electric charge generating material, hole transferring material and electron transferring material, and the smoothness of the surface of the photosensitive layer, for example, surfactants and leveling agents may be used.

<Examples>

The following Examples and Comparative Examples further illustrate the present invention. The following embodiments are therefore to be considered as illustrative and the technical scope of the present invention is not limited by the embodiments.

EXAMPLES 1 to 11

4.5 Parts by weight of a X type metal-free phthalocyanine (CGM) as the electric charge generating material, 65 parts by weight of a hole transferring material [one selected from (HT1) to (HT3)], 30 parts by weight of an electron transferring material [one selected from (ET1) to (ET7)], 100 parts by weight of a bisphenol Z type polycarbonate resin having a weight-average molecular weight of 30,000 as the binder resin, and 760 parts by weight of tetrahydrofuran were mixed and dispersed in a ball mill for 27 hours to prepare a coating solution for single-layer type photosensitive layer. Then, this coating solution was coated on an aluminum tube as the conductive substrate by using the dip coating method, followed by hot-air drying at 110° C. for 40 minutes to obtain a single-layer type photosensitive material having a single photosensitive layer of 27.5 $\mu$m in film thickness, respectively.

COMPARATIVE EXAMPLES 1 to 7

In the same manner as in Examples 1 to 11, except for using one selected from (ET8) to (ET1) as the electron transferring material, single-layer type photosensitive materials were produced, respectively. (ET8) having a mobility of $6.00\times10^{-10}$ cm$^2$/V/sec

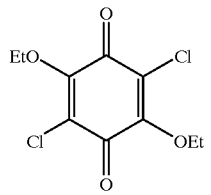

(ET9) having a mobility of $7.56\times10^{-10}$ cm$^2$/V/sec

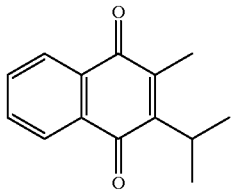

(ET10) having a mobility of $2.08\times10^{-6}$ $cm^2/V/sec$

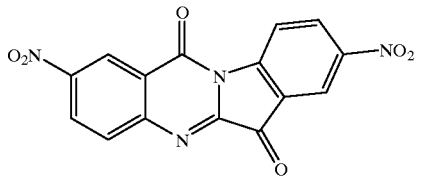

(ET11) having a mobility of $2.77\times10^{-6}$ $cm^2/V/sec$

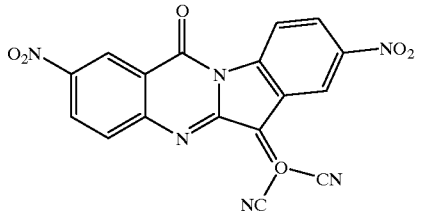

COMPARATIVE EXAMPLES 8 to 14

In the same manner as in Examples 1 to 11, except for using (HT4) as the hole transferring material, single-layer type photosensitive materials were produced, respectively.

(HT4) having a mobility of $1.60\times10^{-6}$ $cm^2/V/sec$

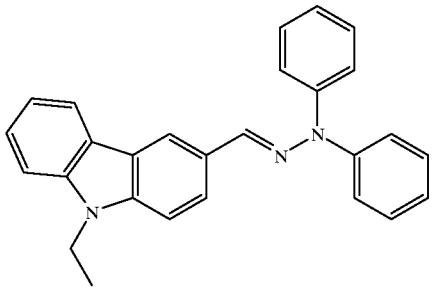

The electrophotosensitive materials of the above respective Examples and Comparative Examples were subjected to the following test and the characteristics were evaluated, respectively.

<Evaluation of initial sensitivity>

Using a drum sensitivity tester (trade name: GENETEC SINCIA 30M) manufactured by GENETEC Co., a voltage was applied on the surface of each of electrophotosensitive materials of the respective Examples and Comparative Examples to charge the surface at +800 V.

Then, monochromic light having a wavelength of 780 nm (half-width: 20 nm, light intensity: 15 $\mu W/cm^2$) from white light of a halogen lamp as an exposure light source of the above tester through a band-pass filter was irradiated on the surface of each of electrophotosensitive materials in the charged state (exposure time: 40 msec). Furthermore, a surface potential at the time at which 500 msec have passed since the beginning of exposure was measured as a residual potential $V_L$ (V). The smaller the residual potential, the higher the sensitivity of the photosensitive material.

To obtain a sufficient image density in a high-speed image forming apparatus capable of taking 50 or more copies of a A4-size original per minute, the residual potential must be 170 V or less.

<Evaluation of initial charging>

Using the above drum sensitivity tester, an initial surface potential $V_0$ (V) of each of electrophotosensitive materials of the respective Examples and Comparative Examples was measured at a value of a current to be applied of 12 $\mu$A. Charging was effected by a corotron system.

To obtain an image, which is free from fog, in a high-speed image forming apparatus capable of taking 50 or more copies of a A4-size original per minute, the initial surface potential must be 750 V or more.

<Evaluation of image>

Each of the electrophotosensitive materials obtained in the respective Examples and Comparative Examples was mounted to a high-speed image forming apparatus capable of taking 50 or more copies of a A4-size original per minute [Creage 7350, manufactured by Mita Industries Co., Ltd.] and a practical copying test was effected. Then, a solid reflection density was measured by using a reflection densitometer manufactured by Nippon Denshoku Co., Ltd.

An image density (ID) is a value obtained by measuring the density of the solid black portion. A fog density (FD) is a density obtained by subtracting a reflection density of a white paper before copying from a reflection density of the non-image area after copying.

The image density of not less than 1.3 was rated "pass", while the image density of smaller than 1.3 was rated "fail". The fog density of not more than 0.005 was rated "pass", while the fog density of not less than 0.006 was rated "fail".

The evaluation results are shown in Table 1. In case where the mobility of the hole transferring material at the electric field strength of $5\times10^5$ V/cm is smaller than $1\times10^{-5}$ $cm^2/V/sec$ (shown in Comparative Examples 8 to 14), the residual potential $V_L$ of the photosensitive material became larger than 170 V and a sufficient image density could not be obtained, as shown in FIG. 1.

Figure 2:
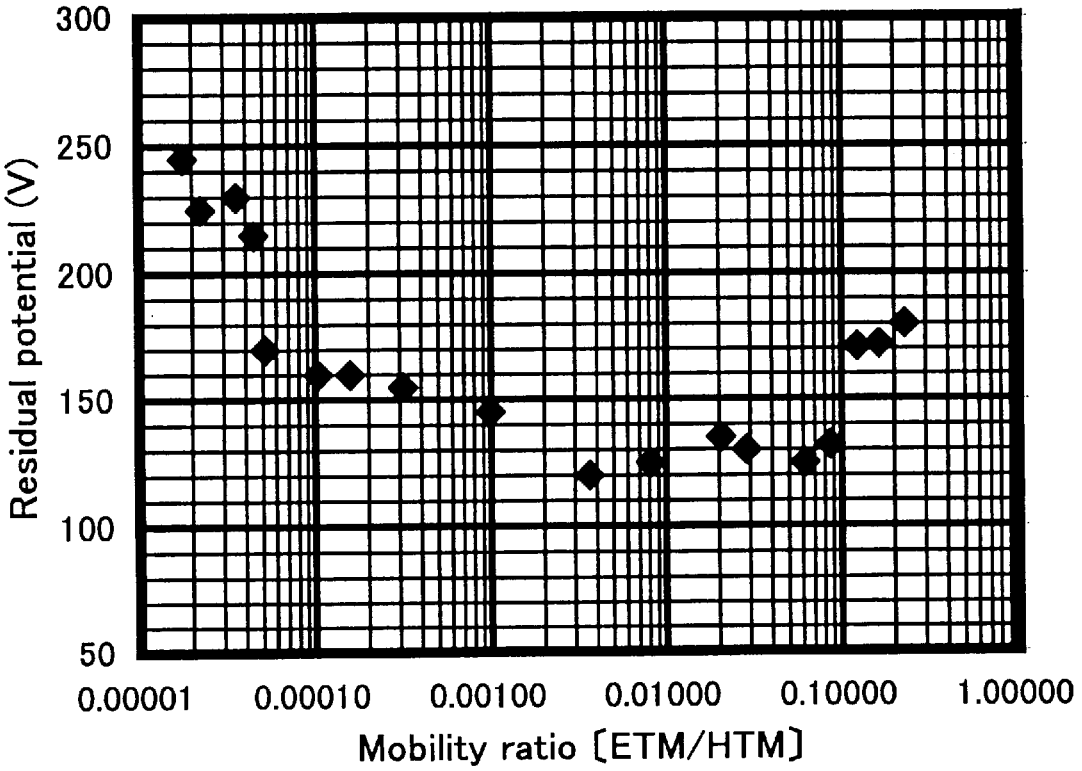
FIG. 2 is a graph showing a relation between a residual potential of a photosensitive material and a mobility ratio [electron transferring material (ETM)/hole transferring material (HTM)] in case where a mobility of the hole transferring material at an electric field strength of $5\times10^5$ V/cm is not less than $1\times10^{-5}$ $cm^2$/V/sec.
Figure 3:
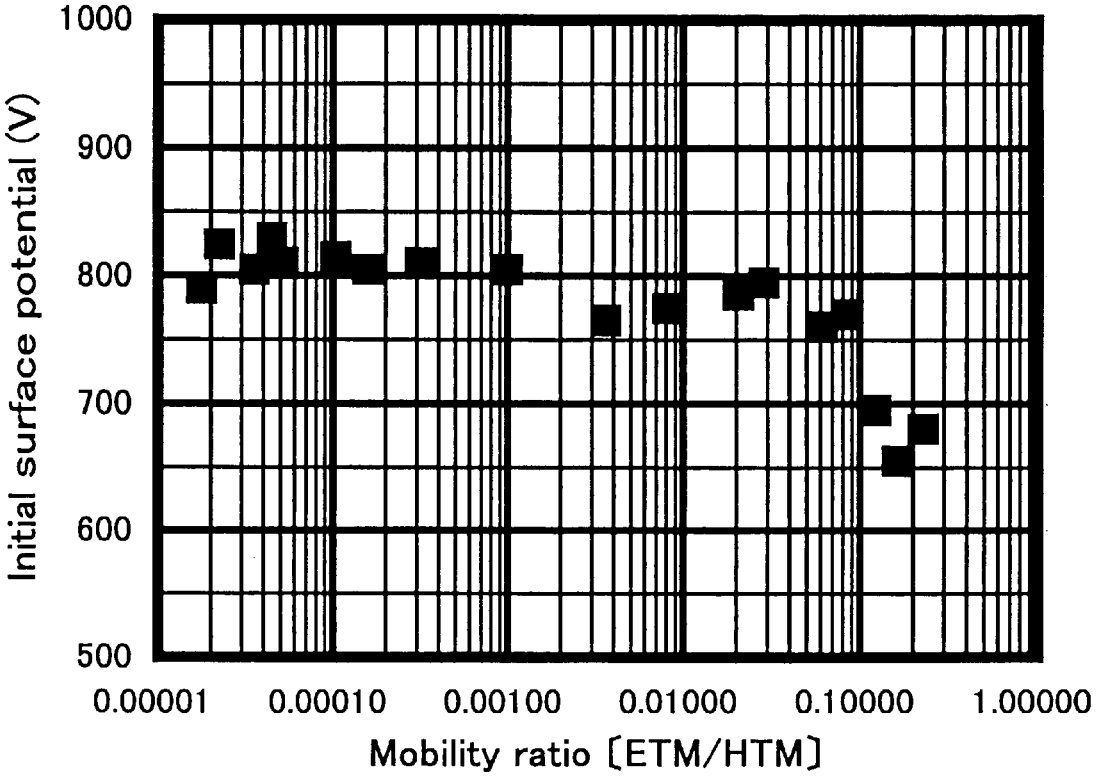
FIG. 3 is a graph showing a relation between an initial surface potential of a photosensitive material and a mobility ratio [electron transferring material (ETM)/hole transferring material (HTM)] in case where a mobility of the hole transferring material at an electric field strength of $5\times10^5$ V/cm is not less than $1\times10^{-5}$ $cm^2$/V/sec.

A relation between a residual potential $V_L$ (V) and a mobility ratio [electron transferring material (ETM)/hole transferring material (HTM)] in case where a mobility of the hole transferring material at an electric field strength of $5\times10^5$ V/cm is not less than $1\times10^{-5}$ $cm^2/V/sec$ is shown in FIG. 2, while a relation between an initial surface potential $V_0$ and a mobility ratio is shown in FIG. 3 (with respect to Examples 1 to 11 and Comparative Examples 1 to 7).

As is apparent from FIGS. 2 and 3, the residual potential $V_L$ of the photosensitive material is not more than 170 V and the initial surface potential $V_0$ is not less than 750 V in case where the mobility ratio is not less than 1/20000 and not more than 1/10. As is apparent from Table 1, image fog did not occur even in a practical test using a high-speed image forming apparatus capable of taking 50 or more copies of a A4-size original and a sufficient image density having ID of not less than 1.3 was obtained.

On the other hand, in case where the mobility ratio is smaller than 1/20000, the residual potential $V_L$ of the photosensitive material became larger than 170 V and a sufficient image density could not be obtained. In case where the mobility ratio is larger than 1/10, the initial surface potential $V_0$ of the photosensitive material was smaller than 750 V and image fog occurred.

TABLE 1

| Examples/Comp. Examples | Kind of HTM | Mobility [$cm^2$/V/sec] | Kind of ETM | Mobility [$cm^2$/V/sec] |
|---|---|---|---|---|
| Example 1 | HT1 | $1.21 \times 10^{-5}$ | ET7 | $1.04 \times 10^{-6}$ |
| Example 2 | HT2 | $1.69 \times 10^{-5}$ | ET7 | $1.04 \times 10^{-6}$ |
| Example 3 | HT1 | $1.21 \times 10^{-5}$ | ET6 | $3.47 \times 10^{-7}$ |
| Example 4 | HT2 | $1.69 \times 10^{-5}$ | ET6 | $3.47 \times 10^{-7}$ |
| Example 5 | HT2 | $1.69 \times 10^{-5}$ | ET5 | $1.37 \times 10^{-7}$ |
| Example 6 | HT2 | $1.69 \times 10^{-5}$ | ET4 | $6.13 \times 10^{-8}$ |
| Example 7 | HT2 | $1.59 \times 10^{-5}$ | ET3 | $1.67 \times 10^{-8}$ |
| Example 8 | HT2 | $1.69 \times 10^{-5}$ | ET2 | $5.32 \times 10^{-9}$ |
| Example 9 | HT3 | $3.38 \times 10^{-5}$ | ET2 | $5.32 \times 10^{-9}$ |
| Example 10 | HT2 | $1.69 \times 10^{-5}$ | ET1 | $1.75 \times 10^{-9}$ |
| Example 11 | HT3 | $3.38 \times 10^{-5}$ | ET1 | $1.75 \times 10^{-9}$ |
| Comp. Example 1 | HT2 | $1.69 \times 10^{-5}$ | ET10 | $2.08 \times 10^{-6}$ |
| Comp. Example 2 | HT2 | $1.69 \times 10^{-5}$ | ET11 | $2.77 \times 10^{-6}$ |
| Comp. Example 3 | HT1 | $1.21 \times 10^{-5}$ | ET11 | $2.77 \times 10^{-6}$ |
| Comp. Example 4 | HT2 | $1.69 \times 10^{-5}$ | ET9 | $7.56 \times 10^{-10}$ |
| Comp. Example 5 | HT2 | $1.69 \times 10^{-5}$ | ET8 | $6.00 \times 10^{-10}$ |
| Comp. Example 6 | HT3 | $3.38 \times 10^{-5}$ | ET9 | $7.56 \times 10^{-10}$ |
| Comp. Example 7 | HT3 | $3.38 \times 10^{-5}$ | ET8 | $6.00 \times 10^{-10}$ |
| Comp. Example 8 | HT4 | $1.60 \times 10^{-6}$ | ET7 | $1.04 \times 10^{-6}$ |
| Comp. Example 9 | HT4 | $1.60 \times 10^{-6}$ | ET6 | $3.47 \times 10^{-7}$ |
| Comp. Example 10 | HT4 | $1.60 \times 10^{-6}$ | ET5 | $1.37 \times 10^{-7}$ |
| Comp. Example 11 | HT4 | $1.60 \times 10^{-6}$ | ET4 | $6.13 \times 10^{-8}$ |
| Comp. Example 12 | HT4 | $1.60 \times 10^{-6}$ | ET3 | $1.67 \times 10^{-8}$ |
| Comp. Example 13 | HT4 | $1.60 \times 10^{-6}$ | ET2 | $5.32 \times 10^{-9}$ |
| Comp. Example 14 | HT4 | $1.60 \times 10^{-6}$ | ET1 | $1.75 \times 10^{-9}$ |

| Examples/Comp. Examples | Mobility ratio (ETM/HTM) | Residual potential $V_L$ [V] | Surface potential $V_O$ [V] | Image density ID | Fog density FD |
|---|---|---|---|---|---|
| Example 1 | 0.085950 | 132 | 770 | 1.37 | 0.003 |
| Example 2 | 0.061538 | 125 | 760 | 1.37 | 0.003 |
| Example 3 | 0.028678 | 130 | 795 | 1.38 | 0.004 |
| Example 4 | 0.020533 | 135 | 785 | 1.38 | 0.002 |
| Example 5 | 0.008107 | 125 | 775 | 1.37 | 0.003 |
| Example 6 | 0.003627 | 120 | 765 | 1.37 | 0.004 |
| Example 7 | 0.000988 | 145 | 805 | 1.36 | 0.004 |
| Example 8 | 0.000315 | 155 | 810 | 1.34 | 0.004 |
| Example 9 | 0.000157 | 160 | 805 | 1.37 | 0.002 |
| Example 10 | 0.000104 | 160 | 815 | 1.36 | 0.003 |
| Example 11 | 0.000052 | 170 | 810 | 1.31 | 0.004 |
| Comp. Example 1 | 0.123077 | 171 | 695 | 1.28 | 0.011 |
| Comp. Example 2 | 0.163905 | 172 | 655 | 1.27 | 0.016 |
| Comp. Example 3 | 0.228926 | 180 | 680 | 1.23 | 0.014 |
| Comp. Example 4 | 0.000045 | 215 | 830 | 1.21 | 0.004 |
| Comp. Example 5 | 0.000038 | 230 | 805 | 1.22 | 0.005 |
| Comp. Example 6 | 0.000022 | 225 | 825 | 1.21 | 0.004 |
| Comp. Example 7 | 0.000018 | 245 | 790 | 1.23 | 0.005 |
| Comp. Example 8 | 0.650000 | 180 | 780 | 1.21 | 0.003 |
| Comp. Example 9 | 0.216875 | 179 | 780 | 1.19 | 0.003 |
| Comp. Example 10 | 0.085625 | 174 | 770 | 1.21 | 0.003 |
| Comp. Example 11 | 0.038313 | 175 | 760 | 1.24 | 0.004 |
| Comp. Example 12 | 0.010438 | 200 | 800 | 1.26 | 0.004 |
| Comp. Example 13 | 0.003325 | 205 | 805 | 1.18 | 0.004 |
| Comp. Example 14 | 0.001094 | 210 | 810 | 1.17 | 0.005 |

The disclosure of Japanese Patent Application Serial No.11-141646, filed on May 21, 1999, is incorporated herein by reference.

What is claimed is:

1. A positive charging single-layer type electrophotosensitive material comprising a conductive substrate and a photosensitive layer provided on the conductive substrate, said photosensitive layer comprising an electron charge generating material, a hole transferring material, an electron transferring material and a binder resin, characterized in that a mobility of the hole transferring material at an electric field strength of $5\times10^5$ V/cm is not less than $1\times10^{-5}$ $cm^2$/V/sec and that the electron transferring material has a mobility of not less than 1/20000 and not more than 1/10 relative to that of the hole transferring material.

2. The positive charging single-layer type electrophotosensitive material according to claim 1, wherein the electric charge generating material is a phthalocyanine compound.

3. The positive charging single-layer type electrophotosensitive material according to claim 2, wherein a residual potential at the time of irradiation with monochromic light having a wavelength of 780 nm and a light intensity of 15 $\mu$W for 40 msec is not more than 170 V.

4. The positive charging single-layer type electrophotosensitive material according to claim 2, wherein an initial surface potential at the time at which a value of a current to be applied into the photosensitive layer is 12 $\mu$A is not less than 750 V.

5. A high-speed digital image forming apparatus, which is capable of taking 50 or more copies of a A4-size original wherein the positive charging single-layer type electrophotosensitive material of claim 2 is used in said apparatus.

* * * * *